United States Patent [19]

Tebbutt et al.

[11] 4,090,004

[45] May 16, 1978

[54] CONTAINERS

[75] Inventors: Charles N. Tebbutt, Ruislip; Charles D. V. Still, Wallingford, both of England

[73] Assignee: Metal Box Limited, Reading, England

[21] Appl. No.: 648,034

[22] Filed: Jan. 9, 1976

[30] Foreign Application Priority Data

Jan. 13, 1975 United Kingdom ..... 1428/75

[51] Int. Cl.[2] ..... B21D 51/00; F24M 3/00

[52] U.S. Cl. ..... 428/64; 113/121 A; 220/357; 220/359

[58] Field of Search ..... 113/121 AP, 121 R, 121 C, 113/121 E, 121 A; 220/66, 67, 76, 356, 357, 359; 428/64, 65

[56] References Cited

U.S. PATENT DOCUMENTS

| | | | |
|---|---|---|---|
| 546,498 | 9/1895 | Sturges | 113/121 R X |
| 1,884,699 | 10/1932 | Hothersoll | 113/121 R |
| 1,915,299 | 6/1933 | Draper | 113/121 R |
| 2,197,439 | 4/1940 | Sebell | 113/121 R X |
| 3,085,324 | 4/1963 | Nelson | 113/121 R X |

FOREIGN PATENT DOCUMENTS

| | | | |
|---|---|---|---|
| 563,177 | 11/1932 | Germany | 113/121 R |
| 34,966 | 5/1922 | Norway | 113/121 R |
| 1,071,218 | 6/1967 | United Kingdom. | |

*Primary Examiner*—Leon Gilden

*Attorney, Agent, or Firm*—Diller, Brown, Ramik & Wight

[57] ABSTRACT

A lid and ring to receive it are made from a piece of sheet metal by drawing a preform which has a first portion surrounding a second portion, separating the first portion from the second portion and further forming it to a ring adapted to receive a lid formed from the second portion.

8 Claims, 11 Drawing Figures

CONTAINERS

This invention relates to methods of making containers and more particularly though not exclusively, to containers having a lid which can be levered from a generally annular ring which forms part of the container body and defines an opening for the same.

Many such lever lidded containers are known, some of which are described in British patent specifications Nos. 24,353 of 1906 and 832,383. Hitherto it has been customary to stamp the lid from one sheet of metal and the lever ring from another sheet of metal. This procedure wastes the peripheral margins around each stamping, and the discs removed to create the rings have also been discarded because they are difficult to feed to high speed presses.

According to one aspect the present invention provides a method of making a ring and lever lid from sheet material, said method comprising the steps of forming a preform adapted to provide sufficient material in a first portion for the ring and in a second portion for the lid, said first portion surrounding said second portion;

separating said first portion from said second portion;

further forming said second portion into a lever lid and further forming said first portion into a ring capable of being fitted to a container and receiving the lid.

In one method according to the invention the preform is provided with a closure panel and a peripheral wall upstanding from the closure panel and having an outwardly disposed flange form suitable for attachment to a container.

In a preferred method, a radial step is formed in the wall upstanding from the closure panel, said radial step being severed along a line between its inner and outer diameters to separate the first portion from the second portion, thereby providing a start curl for the ring orifice which is to receive the lid and start flange upon the periphery of the lid.

According to another aspect the invention provides a preform drawn from sheet metal to have a first portion generally surrounding a second portion, said second portion being adapted to permit further forming thereof into a lid and said first portion being adapted to permit further forming thereof into a ring, capable of being fitted to a container and of receiving the lid after separation of said first and second portions from each other.

According to a further aspect of the invention provides a ring and lever lid for a container, made according to the method of the invention, said ring comprising an annular seaming hook, a chuck wall, an inwardly disposed margin appended to which is a substantially cylindrical portion which terminates in an inward curl of internal diameter suitable to receive the lever lid, said lid comprising a closure panel, a peripheral plug wall terminating in an outward curl, said peripheral plug wall of the lid engaging with the internal curl of the ring.

In a preferred embodiment the internal curl is elongaged along the axis of the container so that the inward curl shall extend above the radial margin of the ring.

Lids made according to the invention may be adhered to the rings so made.

Various embodiments of the invention will now be described, by way of example, and with reference to the accompanying drawings, of which:

Figure 1:
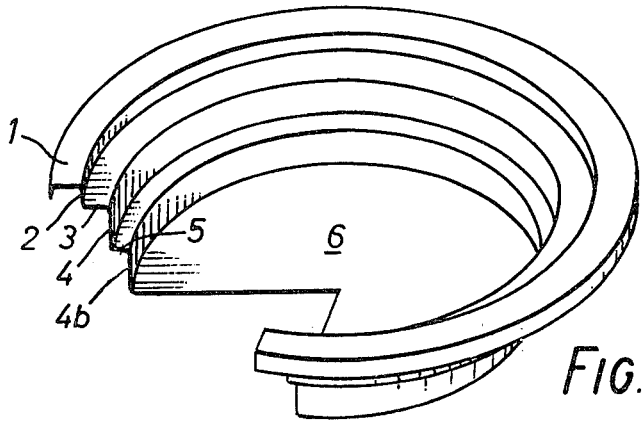
FIG. 1 is a perspective sketch, part sectioned, to show a perferred preform according to the invention.

The preferred preform shown in FIG. 1 has a seaming panel 1, a dependant chuck wall 2, radially flanged margin 3, cylindrical portions 4*a* and 4*b*, joined by a radial step 5 and a closure panel 6. This preform is formed from a sheet of meterial and according to the method of the invention the preform provides a first portion, made up of the seaming panel [1], chuck wall [2], radial margin [3], upper cylindrical portion 4*a* and part of the inwardly directed radial step 5, this first portion being used to create a ring which is able to receive a lid made from the second portion which is made up of the lower cylindrical portion 4*b*, the inner part of the radial step 5 and the closure panel 6.

FIGS. 2–7 show how the preform is made, severed and further formed to create the lid.

Figure 2:
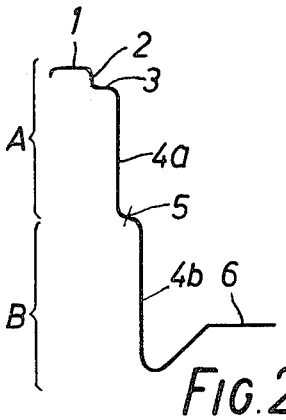
FIG. 2 is a diagrammatic part section of the preform of FIG. 1.
Figure 3:
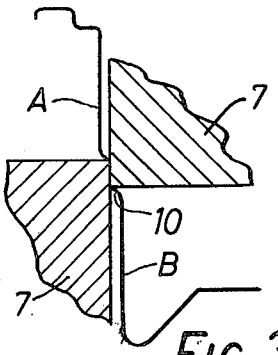
FIG. 3 shows diagrammatically the separation of the ring portion from the lid portion.

In FIG. 2 the first portion is indicated by (A) and the second portion by (B). Referring to FIG. 3 the first portion (A) is shown being severed from the second portion (B) by tools 7.

Figure 4:
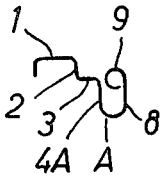
FIG. 4 shows diagrammatically a detailed section of the completed ring.

Referring to FIG. 4, it will be seen that the first portion (A) is further formed to create an elongated wall 8 terminating in an outward curl 9. By careful control of the curling operation the wall 8 can be formed to define the orifice to receive the lid.

Figure 5:
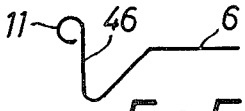
FIG. 5 shows diagrammatically a detail of the curled lid.

Referring to FIG. 5 it will be seen that the second portion (B) of FIG. 3 has been further formed so that the start curl 10 of FIG. 3 is turned into the more complete curl 11 of FIG. 5.

Figure 6:
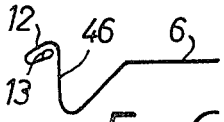
FIG. 6 shows diagrammatically the curl of FIG. 5 flattened to a preferred shape.

In FIG. 6 the curl of FIG. 5 has been further flattened to create a flattened curl 12 having the raw edge of the material 13 folded within the curl. This arrangement is helpful in avoiding the unsightliness of rusty edges on the lid.

Figure 7:
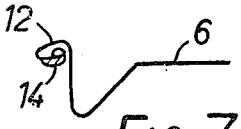
FIG. 7 shows diagrammatically the lid of FIG. 6 with adhesive applied to the curl.

In FIG. 7 the lid curl 12 has had an adhesive 14 positioned on the underside thereof the purpose of which will be described later.

Figure 8:
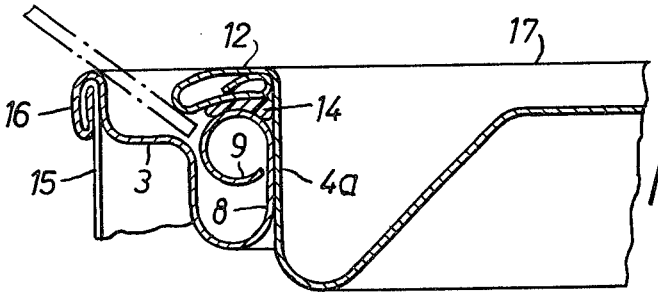
FIG. 8 is a sectioned side elevation showing closure details of the assembled lid and ring.

FIG. 8 shows a side elevation of part of a can fitted with a ring and lid according to the invention. The seaming panel 1 of the ring has been joined to a container wall 15 by means of a known double seam 16. It will be seen that the radial margin 3 separates the upstanding portion 8 from the container walls, so giving the ring assembly better ability to resist abuse in the event of impacts. The upstanding portion 8 and curl 9 of the ring represent a resilient mouth for the container into which a lid 17 is fitted so that the cylindrical portion 4*a* is a push fit within the ring. The lid has been provided with the flattened curl 12 of FIG. 7 which is provided with the sealant adhesive 14. The sealant is particularly useful when the ring and lid have been made shallow for reasons of economy of material because in these conditions the margin of interference to hold the lid in the ring is small. However, it is within the scope of the invention to manufacture lids without sealant or adhesive.

Although the invention has been described in terms of what the trade knows as a cushion ring having a resilient mouth to receive the lid, the lids of the simpler type without such resilience are also within the scope of the invention. It will be understood that considerable economies in material can be achieved by the simultaneous stamping of the lid material nested within the ring material. Furthermore the invention enables balanced quantities of components to be produced, so simplifying stock control.

Figure 9:
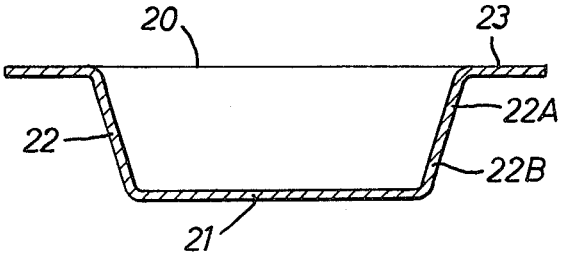
FIG. 9 is a sectioned side view of an alternative preform.

In FIG. 9 a preform 20 has been drawn from sheet metal to have a closure panel portion 21 and a peripheral wall 22 extending upwardly and outwardly to an outwardly flanged portion 23. The wall portion 21 has a frustoconical upper portion 22A and a frustoconical lower portion 22B.

According to the method of the invention the wall portion 21 is severed, between the upper and lower frustoconical portions 22A and 22B and a first portion comprising the flange 23 and upper frustoconical portion 22A is reformed to make a ring adapted to receive a lid made from the second portion comprising the frustoconical portion 22B and closure panel 21.

Figure 10:
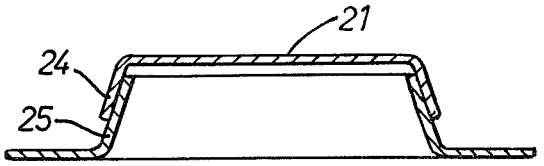
FIG. 10 is a sectioned side view of an overcap arrangement.

In FIG. 10 the lid formed from the second portion is in the form of an overcap having a closure panel 21 and a peripheral dependent reformed skirt 24 which surrounds and engages with the reformed upper frustoconical portion denoted 25. Such a closure arrangement may benefit from the addition of adhesive (not shown) at the zone of engagement between cap and ring.

Figure 11:
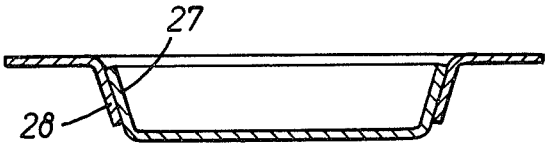
FIG. 11 is a sectioned side view of a plug lid embodiment.

In FIG. 11 the second position comprising the lower frustoconical portion 22B and closure panel 21 of the preform 20 have been reformed into a plug lid 27 which fits within the reformed ring 28 made from the first portion, of the preform.

Although only preferred embodiments and methods have been specifically illustrated and described herein, it is to be understood that minor variations may be made in the method and the utilization thereof without departing from the spirit and scope of the invention, as defined by the appended claims.

We claim:

1. A method of forming a two-piece container closure of the type including an annular ring having means for securement to a container, and a separable lid interlockingly engageable with said annular ring, said method comprising the steps of forming sheet material into a generally cup shaped preform having first and second portions generally corresponding to said annular ring and said lid, separating said first and second portions, and separately further shaping said first and second portions to form said annular ring and said lid, said step of forming said preform including the steps of forming on said first and second portions concentric upstanding wall portions, forming an annular step between said wall portions with said annular step sloping outwardly and axially from said second portion to said first portion and directly connecting together said concentric upstanding wall portions, and effecting said separating of said first and second portions by applying opposed radially offset concentric forces on said annular step and both severing said annular step in two parts and deforming the two parts of said annular step as a first step of said further shaping of said first and second portions.

2. The method of claim 1 wherein said deforming of said annular step two parts are first steps in forming opposite turning curls, and said further shaping of said first and second portions including the completion of said curls.

3. The method of claim 2 wherein said further shaping of said first portion includes inwardly reversely turning of the upstanding wall portion thereof to define an inner cylindrical wall portion having an inner diameter of a size to snuggly receive the upstanding wall portion of said second portion.

4. The method of claim 3 wherein the reversely turning of said first portion upstanding wall portion results in a U-shaped cross-section formation, and the curl of said first portion being received in and substantially closing said U-shaped cross-section formation.

5. The method of claim 1 wherein said further shaping of said first portion includes inwardly reversely turning of the upstanding wall portion thereof to define an inner cylindrical wall portion having an inner diameter of a size to snuggly receive the upstanding wall portion of said second portion.

6. The method of claim 5 wherein the reversely turning of said first portion upstanding wall portion results in a U-shaped cross-section formation.

7. A two-piece preform for forming an end unit for a container wherein said end unit is of the type including an annular ring having means for securement to a container body and a separable lid, said preform initially being of one piece and comprising an outer portion for forming an outer ring and an inner portion for forming a lid, said outer ring having an inner cylindrical portion terminating in a lower inwardly and downwardly directed and inwardly turning part, and said lid having an outer cylindrical portion of a lesser diameter than said inner cylindrical portion, said outer cylindrical portion terminating in an upper upwardly and outwardly directed and outwardly turning parts.

8. The preform of claim 7 wherein said parts have circular free edges of substantially identical diameters.

* * * * *